US007130550B2

(12) United States Patent
Mochizuki

(10) Patent No.: US 7,130,550 B2
(45) Date of Patent: Oct. 31, 2006

(54) IMAGE FORMING APPARATUS FEATURING A CHANGEABLE MIXING RATIO OF DEEP AND PALE COLOR TONERS

(75) Inventor: Jun Mochizuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 10/900,284

(22) Filed: Jul. 28, 2004

(65) Prior Publication Data

US 2005/0036798 A1 Feb. 17, 2005

(30) Foreign Application Priority Data

Aug. 1, 2003 (JP) ..... 2003-205388

(51) Int. Cl.
*G03G 15/00* (2006.01)

(52) U.S. Cl. ..... 399/45; 399/44; 399/54

(58) Field of Classification Search ..... 399/44, 399/45, 54

See application file for complete search history.

(56) References Cited

U.S. PATENT DOCUMENTS

2003/0185601 A1* 10/2003 Toyohara et al. ..... 399/298

FOREIGN PATENT DOCUMENTS

JP 2000-231279 8/2000

* cited by examiner

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

An image forming apparatus includes image forming means for forming a superposed image on an image bearing member by using at least toners which have an identical hue and different color densities; transfer means for electrostatically transferring the superposed image on the image bearing member onto a transfer material; and changing means for changing a mixing ratio between the toners which have an identical hue and different color densities depending on information on a water content of the transfer material, thereby to prevent a deterioration of an image, particularly a halftone image even in the case where the image is formed under a specific image forming condition, such as in a low humidity environment, liable to cause image deterioration due to a discharge phenomenon in the vicinity of a transfer portion.

7 Claims, 12 Drawing Sheets

IMAGE FORMING APPARATUS FEATURING A CHANGEABLE MIXING RATIO OF DEEP AND PALE COLOR TONERS

This application claims priority from Japanese Patent Application No. 205388/2003 filed Aug. 1, 2003, which is hereby incorporated by reference.

FIELD OF THE INVENTION AND RELATED ART

The present invention relates to an image forming apparatus utilizing an electrophotographic process or an electrostatic recording process, such as a copying machine or a printer. More specifically, the present invention relates to an image forming apparatus employing a combination of toners which have an identical hue and different color densities.

At present, a full-color image forming apparatus including a developing apparatus using toners of four colors of yellow, magenta, cyan and black has been generally used.

For example, as described in Japanese Laid-Open Patent Application (JP-A) No. 2000-231279, an image forming apparatus using a combination of a plurality of toners which have an identical hue and are different in depth of a color, has been proposed. The image forming apparatus of such a type has the advantage of permitting an alleviation of granulation which is noticeable particularly at a low image density portion although this is not limited to the image forming apparatus described in JP-A 2000-231279.

FIG. 1 is a schematic sectional view of the image forming apparatus of such a type.

As shown in FIG. 1, an image forming apparatus 100 include four image formation stations 1, 2, 3 and 4 which are juxtaposed with each other. In each of the image forming stations, an image is outputted by transferring a toner image (visible image), formed on an associated photosensitive drum (1*a*, 2*a*, 3*a*, 4*a*) as an image bearing member, onto a transfer material P according to the electrophotographic process. In each image forming station, a first developing apparatus (first developing means) (1*c*1, 2*c*1, 3*c*1 4*c*1) and a second developing apparatus (second developing means) (1*c*2, 2*c*2, 3*c*2, 4*c*2) are provided. In the first developing apparatuses 1*c*1 to 4*c*1, four color toners of yellow, magenta, cyan and black, each of which has a relatively low color density (hereinafter referred to as a "pale color toner"), are contained, respectively. On the other hand, in the second developing apparatuses 1*c*2 to 4*c*2, four color toners of yellow, magenta, cyan and black, each of which is an ordinary toner, i.e., has a relatively high color density compared with a corresponding pale color toner having an identical hue (hereinafter referred to as a "deep color toner"), are charged, respectively.

By using the image forming apparatus having the above-described structure, a toner image is formed by developing an electrostatic latent image formed on the associated photosensitive drum 1*a*, 2*a*, 3*a* or 4*a* with the associated pale color toner by the associated first developing apparatus 1*c*1, 2*c*1, 3*c*1 or 4*c*1 for the pale color toner and is primary-transferred onto an intermediary transfer belt 12 at an associated primary transfer portion T1, T2, T3 and T4. Further, a toner image is formed by developing an electrostatic image formed on the associated photosensitive drum 1*a*, 2*a*, 3*a* or 4*a* with the associated deep color toner, and is again primary-transferred onto the intermediary transfer belt 12 on which the toner image with the pale color toner is formed, thus providing a toner image with a combination of the pale color toner and the deep color toner. Thereafter, the resultant toner image is secondary-transferred onto a transfer material P at a secondary transfer portion T' by a secondary transfer apparatus (secondary transfer roller) 11. The transfer material P onto which the toner image is secondary-transferred is conveyed to a fixing apparatus 9, where the toner image is fixed on the transfer material P under application of heat and pressure by a fixing member 9*a* and a pressing member 9*b*, and then is discharged out of the image forming apparatus.

Image information signals obtained as digital signals by scanning an original G with a reader unit (original reading apparatus) 20 are converted from input image signal values (ordinarily 256 levels from 0 to 255) to output image signal values (ordinarily 256 levels from 0 to 255) by using a look-up table (LUT) for pale color toner and an LUT for deep color toner in order to effect pale color toner image formation by the first developing apparatuses 1*c*1 to 4*c*1 and deep color toner image formation by the second developing apparatuses 1*c*2 to 4*c*2, respectively. On the basis of the binarized data, exposure apparatuses 1*b* to 4*b* are driven.

Generally, when a halftone image is formed in a low humidity environment, image deterioration due to a discharge phenomenon in the vicinity of the transfer portion (transfer apparatus) is caused to occur in many cases. It has been clarified that the occurrence of image deterioration is affected by an amount of toner per unit area on the transfer material and the resultant toner image is less liable to be disordered or disturbed at the time of occurrence of discharge phenomenon in the vicinity of the transfer portion as the amount of toner on the transfer material becomes larger.

However, in a conventional image forming apparatus, image formation is performed in accordance with the same LUT irrespective of an image forming condition such as temperature and humidity of an ambient environment. For this reason, deterioration of the halftone image has been caused to occur in some cases by discharge in the vicinity of the transfer portion particularly in a low humidity environment.

SUMMARY OF THE INVENTION

The present invention has been accomplished in view of the above-described circumstances.

An object of the present invention is to provide an image forming apparatus capable of preventing deterioration of an image, particularly a halftone image even in the case where the image is formed under a specific image forming condition such as a low humidity environment wherein image deterioration due to a discharge phenomenon in the vicinity of a transfer portion or at a portion downstream from the transfer portion is liable to occur.

According to the present invention, there is provided an image forming apparatus, comprising:

image forming means for forming a superposed image on an image bearing member by using at least toners which have an identical hue and different color densities;

transfer means for electrostatically transferring the superposed image formed on the image bearing member onto a transfer material; and changing means for changing a mixing ratio between the toners which have an identical hue and different color densities depending on information on a water content of the transfer material.

In an embodiment of the image forming apparatus, an amount of a toner having a relatively low color density of the toners is increased when a humidity of the ambient environment or an absolute water (moisture) content of the transfer material is lower than a predetermined value.

An another embodiment of the present invention, there is provided an image forming apparatus, comprising:

image forming means for forming a superposed image on an image bearing member by using at least toners which have an identical hue and different color densities, and transfer means for electrostatically transferring the superposed image formed on the image bearing member onto a transfer material, wherein an amount of a toner having a relative low color density of the toners is increased when the transfer material has a thickness which is larger than a predetermined value.

As a further embodiment of the present invention, there is provided an image forming apparatus, comprising:

image forming means for forming a superposed image on an image bearing member by using at least toners which have an identical hue and different color densities, and transfer means for electrostatically transferring the superposed image formed on the image bearing member onto a transfer material, wherein an amount of a toner having a relative low color density of the toners is increased when the superposed image is formed under such an image forming condition that a transfer bias voltage to be applied to a transfer portion where a visible image is transferred onto the transfer material.

As a still further embodiment of the present invention, there is provided an image forming apparatus, comprising:

image forming means for forming a superposed image on an image bearing member by using at least toners which have an identical hue and different color densities, and transfer means for electrostatically transferring the superposed image formed on the image bearing member onto a transfer material, and fixing means for fixing the superposed image on the transfer material under heating, wherein an amount of a toner having a relative low color density of the toners is increased when the superposed image formed on a first surface of the transfer material is fixed by the fixing means and then a superposed image is formed on a second surface of the transfer material.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

In the respective drawings, members or means indicated by identical symbols have the same structures or functions. Accordingly, a repetitive explanation thereof will be omitted appropriately.

(Embodiment 1)

Figure 1:
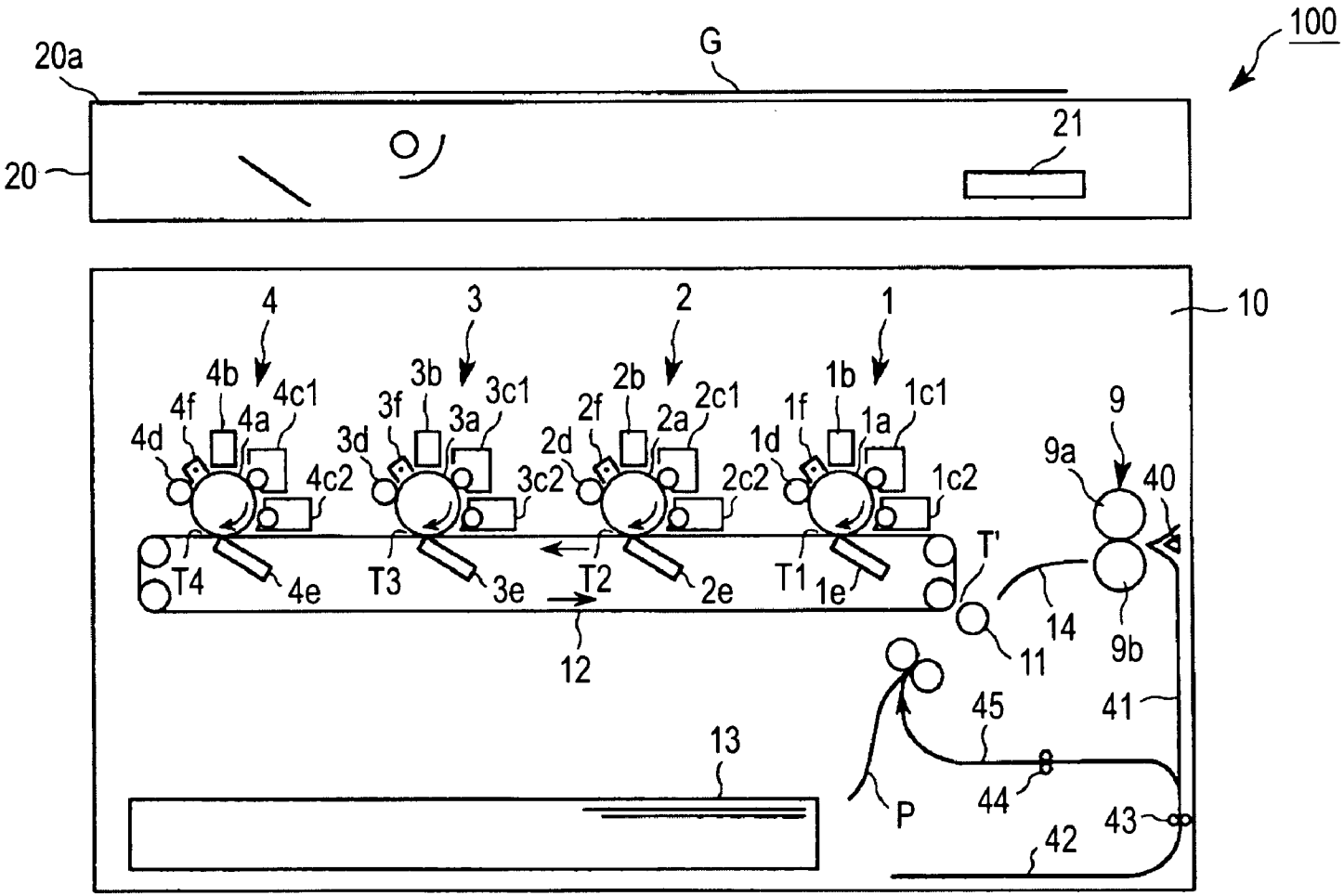
FIG. 1 is a schematic sectional view showing an embodiment of the image forming apparatus according to the present invention.

In this embodiment, an image forming apparatus 100 according to the present invention has a general structure shown in FIG. 1.

The image forming apparatus 100 can form a full-color image on a transfer material P, such as paper or an OHP sheet, in a printer unit 10 on the basis of an image information signal from a reader unit 20 or an external equipment, such as a personal computer, connected to a main assembly of the image forming apparatus so that the external equipment can communicate with the apparatus main assembly.

The image forming apparatus 100 of this embodiment includes four image formation 1 to 4, as a plurality of image forming means, which are juxtaposed with each other in series in a paper feed direction, as shown in FIG. 1. Each of the image formation stations 1 to 4 includes a cylindrical electrophotographic photosensitive member (photosensitive drum) 1*a*, 2*a*, 3*a* or 4*a* as an image bearing member; an exposure apparatus (laser scanning exposure apparatus) 1*b*, 2*b*, 3*b* or 4*b* as an image writing means (latent image forming means); a first developing apparatus (first developing means) 1*c*1, 2*c*1, 3*c*1 or 4*c*1; a second developing apparatus (second developing means) 1*c*2, 2*c*2, 3*c*2 or 4*c*2;

a cleaning apparatus 1*d*, 2*d*, 3*d* or 4*d* as a cleaning means; a corona charger 1*f*, 2*f*, 3*f* or 4*f* as a charging means; and a primary transfer apparatus 1*e*, 2*e*, 3*e* or 4*e* as a primary transfer means. Each of the primary transfer apparatuses 1*e* to 4*e* causes a toner image on an associated photosensitive drum 1*a*, 2*a*, 3*a* or 4*a* to be electrostatically adsorbed by and transferred onto a surface of an intermediary transfer belt (image bearing member) 12 by applying thereto a voltage of a polarity opposite from that of toner from an unshown voltage application means at a transfer portion. Generally, the transfer means is supplied with a transfer bias voltage on the basis of a maximum amount of toner per unit area so as to permit a transfer of toner in a maximum amount per unit area. In this embodiment, a constant voltage is applied as the transfer bias voltage at the transfer portion. However, in the present invention, it is possible to effect a constant current control such that a transfer current at the transfer portion is kept constant, in addition to the above-described constant voltage control, or to effect a combination of the constant current control with the constant voltage control.

Further, the intermediary transfer belt 12 as an intermediary transfer member as an image bearing member is movably disposed in a direction of indicated arrows so as to be passed between the photosensitive drums 1*a* to 4*a* and the primary transfer apparatuses 1*e* to 4*e* in the image forming stations 1 to 4, respectively.

In this embodiment, in the first developing apparatuses 1*c*1 to 4*c*1, developers comprising pale color toners of yellow, magenta, cyan and black, each designed to provide an optical density after fixation of 0.8 when an amount of toner per unit area on the transfer material is a 5 mg/cm$^2$, are contained, respectively. In the second developing apparatuses 1*c*2 to 4*c*2, developers comprising deep color toners of yellow, magenta, cyan and black, each designed to provide an optical density after fixation of 1.6 when an amount of per unit area on the transfer material is 0.5 mg/cm$^2$, are contained, respectively. In this embodiment, in each of the respective developing apparatuses 1*c*1 to 4*c*1 and 1*c*2 to 4*c*2, a two component type developer principally comprising a mixture of toner and a carrier is contained as the developer.

In the present invention the expression, "toners which have an identical hue and different color densities" ordinarily means toners in which a spectrum characteristic of a coloring component (pigment) contained in one toner principally comprising a resin and the pigment is identical to that of the pigment contained in another toner and an amount of the pigment in another toner. Further, the pale color toner is a toner having a relatively low color density in a combination of the toners having an identical hue and different color densities. In the present invention, the pale color toner is ordinarily a toner containing a pigment adjusted to provide an optical density of less than 1.0 with respect to a toner amount per unit area of 0.5 mg/cm$^2$ on the transfer material, and the deep color toner is ordinarily a toner containing a pigment adjusted to provide an optical density of not less than 1.0 with respect to a toner amount per unit area of 0.5 mg/cm$^2$ on the transfer material. Further, the expression "identical hue" ordinarily means that spectral characteristics of coloring component (pigment) contained in toners are identical to each other as described above. However, in the present invention, the identical hue covers not only a strictly identical hue but also such an identical hue that both colors of toners can be classed as the same color, such as magenta, cyan, yellow or black, under an ordinary color concept.

In this embodiment, the first developing apparatuses 1*c*1 to 4*c*1 are disposed upstream from the second developing apparatuses 1*c*2 to 4*c*2, respectively, in a rotation direction indicated by an arrow in an associated photosensitive drum of the photosensitive drums 1*a* to 4*a*.

Figure 3:
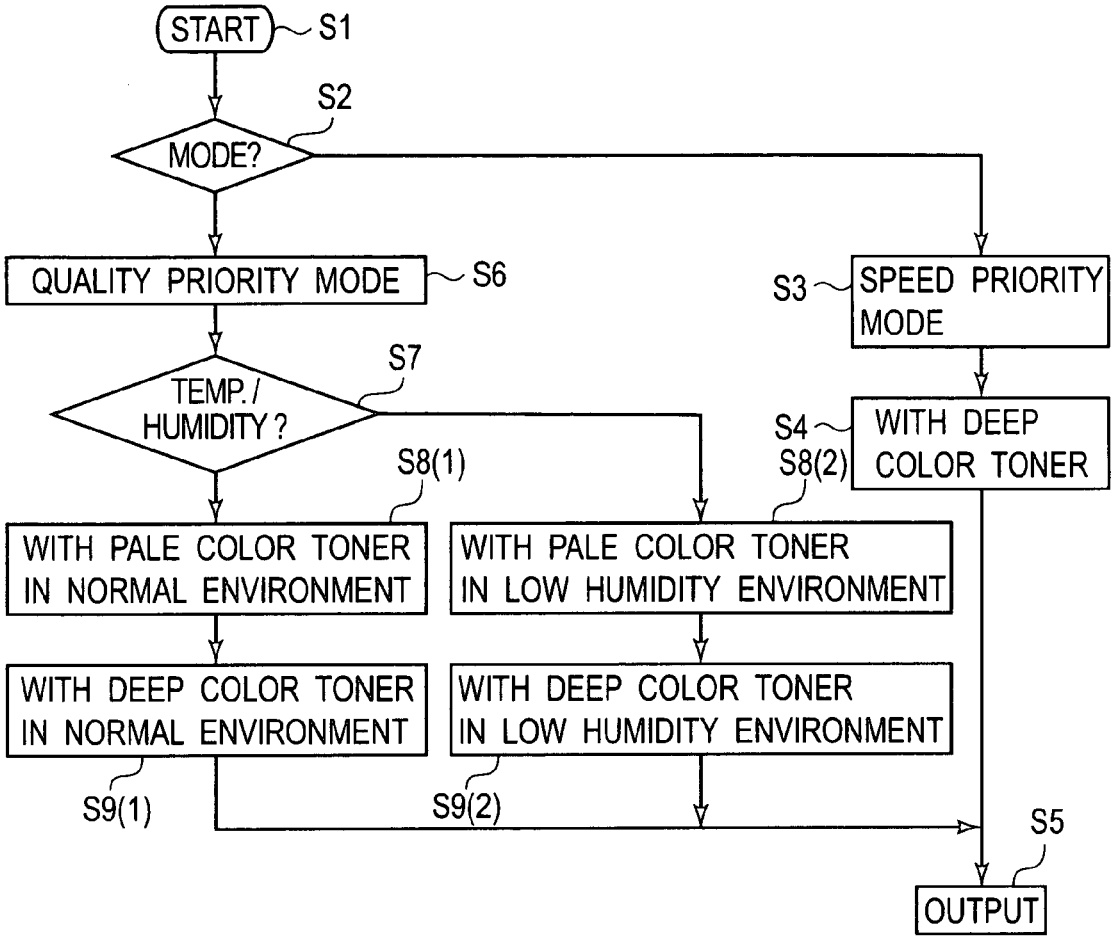
FIG. 3 is a flowchart showing the progress of image forming operation in an embodiment of the present invention.

A basic flowchart of an operation of the image forming apparatus 100 in this embodiment is shown in FIG. 3. The image forming apparatus 100 is provided with two image formation modes including an image quality priority mode and a speed priority mode. As a basic mode, the speed priority mode is set. The speed priority can be changed to the image quality priority mode through an operation by an operator.

When image formation is started (S1), an image formation mode is determined whether it is the speed priority mode or the image quality priority mode (S2).

In the case of the speed priority mode (S3), image formation with the deep color toners is performed by the second developing apparatuses 1*c*2 to 4*c*2 (S4), and an image is outputted (S5).

On the other hand, when the image quality priority mode is selected in the step S2 (S6), as specifically described later, the LUTs (a combination of the LUTs for the pale color toners and the deep color toners) with respect to temperature and humidity of ambient environment (two environments consisting of an ordinary temperature and humidity environment and a low humidity environment in this embodiment) as a specific image forming condition are selected (S7) and thereafter image formation with the pale color toners by the first developing apparatuses 1*c*1 to 4*c*1 (S8(1) or S8(2)) and image formation with the deep color toners by the second developing apparatuses 1*c*2 to 4*c*2 (S9(1) or S9(2)) are performed, thus providing an output image (S5).

In this embodiment, for example, the ordinary temperature and humidity environment means an environment providing an absolute water (moisture) content of 5–15 g/kg, and the low humidity environment means an environment providing an absolute water content of 0–5 g/kg. However, the definitions of these environments are not limited the above environments but may appropriately be set by the operator in view of a degree of frequency of occurrence of image deterioration due to the discharge phenomenon in the vicinity of the transfer portion.

Figure 2:
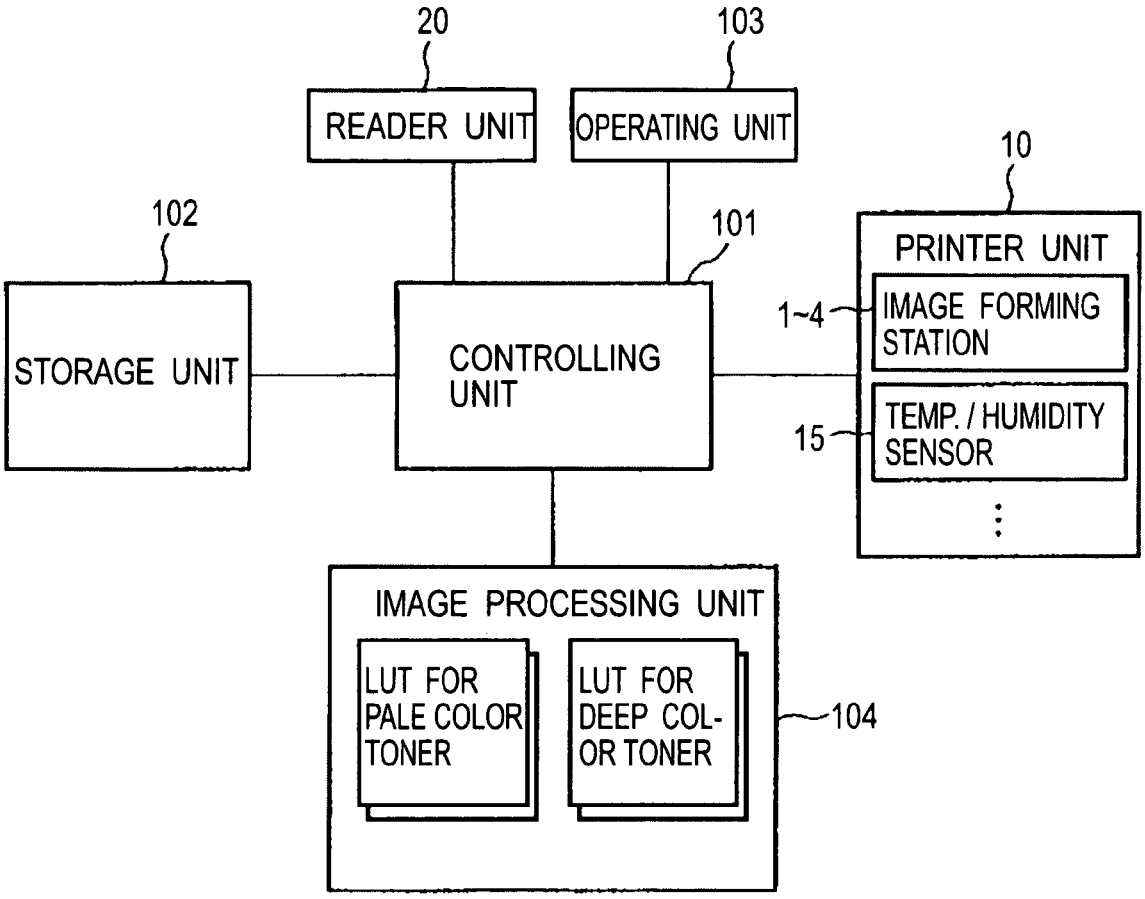
FIG. 2 is a schematic control block diagram showing an image forming operation of the image forming apparatus of the present invention.

A control method of the image forming apparatus 100 in this embodiment will be described with reference to FIG. 2.

In this embodiment, basic control of the image forming apparatus is effected by a controlling unit (CPU) 101 provided in the apparatus main assembly. To the controlling unit 101, a storage unit 102 in which a control program is written and stored is connected. To a printer unit 10, respective loads, such as a motor, a clutch, and a sensor, for driving respective parts of the image forming apparatus are connected. The controlling unit 101 controls the loads in accordance with the contents of a control program to execute an image forming operation. The storing unit 102 further stores image data, operation mode settings of the image forming apparatus, etc. Further, to the controlling unit 101, an operating unit 103 is connected and in the operation unit 103, input of various settings and display of apparatus states are effected. To the controlling unit 101, a reader unit 20 for converting an original image into digital data and an image processing unit (black) 104 for performing image processing of the digital data are connected. The image forming apparatus may further include an interface for performing data input and output with respect to an external equipment such as a host PC connected through a network.

In this embodiment, to the printer unit 10, as a detection means for detecting an image forming condition and inputting a signal in correspondence with the image forming condition into the controlling unit 101, a temperature and humidity sensor 15 for detecting temperature and humidity of ambient environment is provided. The temperature and humidity sensor 15 inputs a signal corresponding to the ambient temperature and humidity into the controlling unit 101. As a result, in this embodiment, on the basis of the detection result of the temperature and humidity sensor 15 as the environment detection means, the image forming apparatus 100 can change the mixing ratio of the toners having an identical hue and different color densities.

The reader unit 20 effects a photoelectric conversion of original image information, and an image signal color-separated into RGB (red, green and blue) is converted into a digital value by an A/D converter in th reader unit 20 and is sent to the controlling unit 101 as image data. The controlling unit 101 determines whether the current mode is the speed priority mode or the image quality priority mode on the basis of input from the operating unit 103 or input means of the external equipment connected to the apparatus main assembly (hereinafter, these are inclusively referred to as the "operating unit"), and also determines whether the image formation mode is the ordinary environment mode or the low humidity environment mode in correspondence with an output of the temperature and humidity sensor 15. Then, the controlling unit 101 transmits the image data to the image processing unit 104 and at the same time, outputs a selection signal of an LUT depending on the determined image formation mode to the image processing unit 104. The image processing unit 104 selectively uses the LUT depending on the image formation mode and converts the transmitted image data as specifically described later to be once stored in the storing unit 102. The controlling unit 101 transmits the image data stored in the storing unit 102 to the printer unit 10, where image formation is effected.

The controlling unit 101, in accordance with an instruction from an operator through the operating unit 103, functions as an image forming mode selection means for selecting either one of the speed priority mode or the image quality priority mode and selecting the ordinary environment mode or the low humidity environment mode on the basis of output of the temperature and humidity sensor 15. Further, the controlling unit 101 also functions as an LUT selection means for selecting a combination of LUTs for the plurality of deep and pale color toners stored in the image processing unit 104 or the storing unit 102.

1) Speed Priority Mode

An operation in the case where the operator selects the speed priority mode will be further described with reference to FIG. 1.

First of all, the original G placed on an original (document) glass plate 20*a* of the reader unit 20 is scanned, and information on the original G is converted into an electrical signal by a CCD (charge-coupled device) 21 and converted into a digital signal by the A/D converter (not shown).

The data converted into the digital signal is processed by the data processing block and the RGB signal is color-converted into a CMYK (cyan, magenta, yellow and black) signal. Thereafter, gamma correction and LUT conversion for deep color toner are performed, and then binarization is effected. The binarized image data are transmitted to a laser driver of the exposure apparatuses 1*b* to 4*b* to drive a laser thereby to effect image formation.

The image forming apparatus 100 in this embodiment is provided with an image memory, for four colors, which is capable of storing image data for four colors subjected to the binarization by one reader scanning.

On the photosensitive drums 1*a* to 4*a* which have been electrically charged at their surfaces by the corona chargers 1*f* to 4*f* in advance, the electrostatic images are developed as toner images with deep color toners by the second developing apparatuses 1*c*2 to 4*c*2, respectively. These toner images are electrostatically primary-transferred onto the intermediary transfer belt 12 by the primary transfer apparatuses 1*e* to 4*e* supplied with a transfer voltage at the primary transfer portions T1 to T4. Further, the toner images are electrostatically secondary-transferred onto the transfer material P conveyed from a paper supply cassette 13 at a secondary transfer portion T' by a secondary transfer apparatus 11 supplied with a transfer voltage. Thereafter, the transfer material P is conveyed to the fixing apparatus 9, where the toner image is fixed on the transfer material P under heating and pressing by the fixing member 9*a* and the pressing member 9*b*, and the transfer material P is discharged out of the image forming apparatus. Toners (transfer residual toners) remaining on the surfaces of the photosensitive drums 1*a* to 4*a* after the primary transfer are removed by the cleaning apparatuses 1*d* to 4*d*.

The image forming apparatus 100 in this embodiment has an image formation rate of 30 cpm (image output of 30 A4-sized sheets per one minute) in the speed priority mode. In this case, however, granulation of one dot at a low image density portion is somewhat promoted.

2) Image Quality Priority Mode

Figure 4:
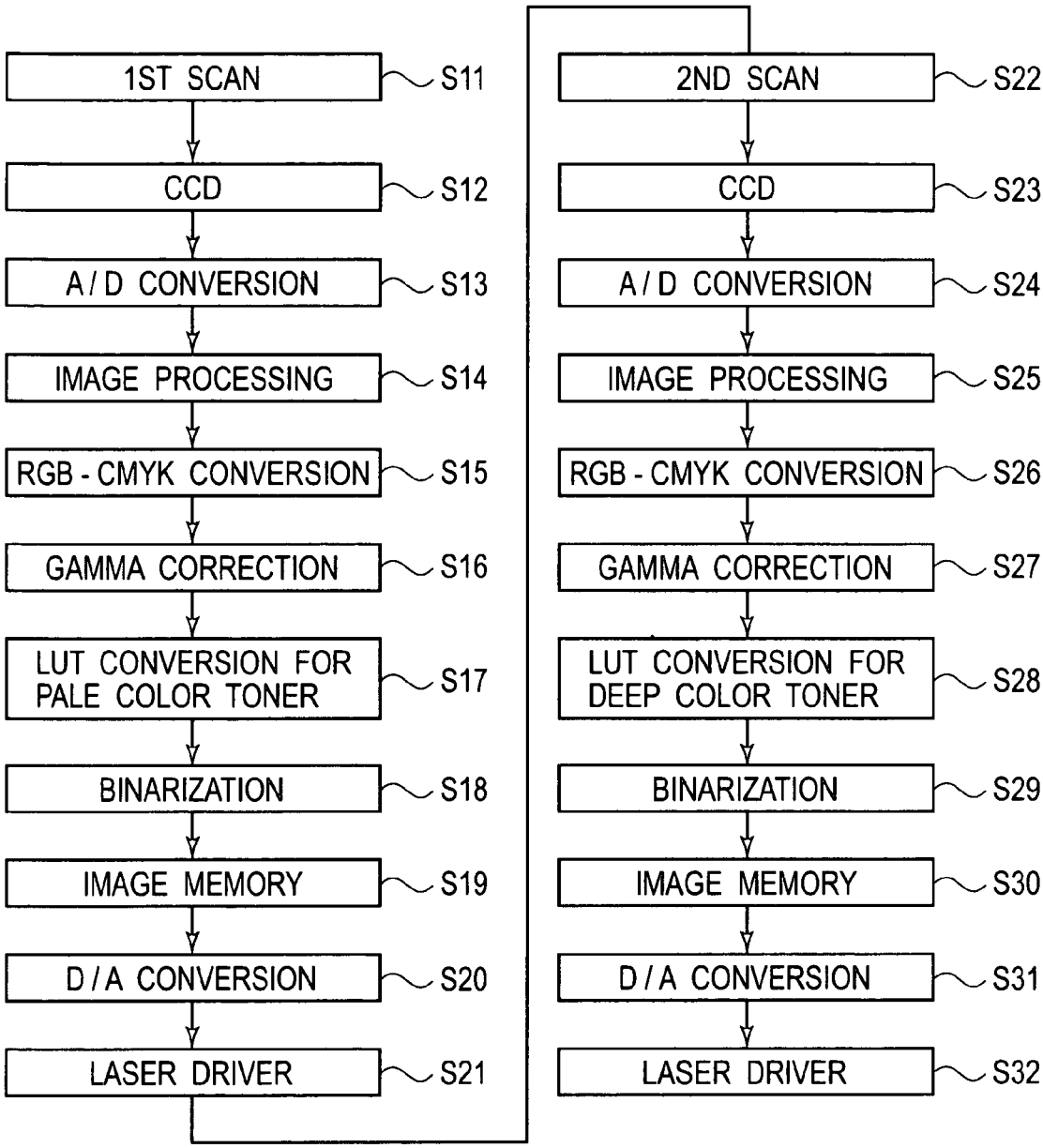
FIG. 4 is a flowchart showing the flow of image signal in an image quality priority mode in an embodiment of the present invention.

Next, an operation in the case where the image quality priority mode is selected will be described. As described above, in this embodiment, the 1 LUT to be selected is different depending on the temperature and humidity of ambient environment but the flow as a whole is the same. FIG. 4 shows a flowchart of an image signal in such a case.

2-1) Ordinary Environment Mode (First Image Formation Mode)

A flow of image signal in the case of forming an image in the ordinary temperature and humidity environment will be described.

First of all, the original G placed on an original (document) glass plate 20*a* of the reader unit 20 is scanned (S11), and information on the original G is converted into an electrical signal by a CCD 21 (S12) and converted into a digital signal by the A/D converter (not shown) (S13). The data converted into the digital signal is processed by the data processing block (S14) and the RGB signal is color-converted into a CMYK signal (S15). Thereafter, gamma correction (S16) and LUT conversion for pale color toner (S17) are performed.

Figure 5:
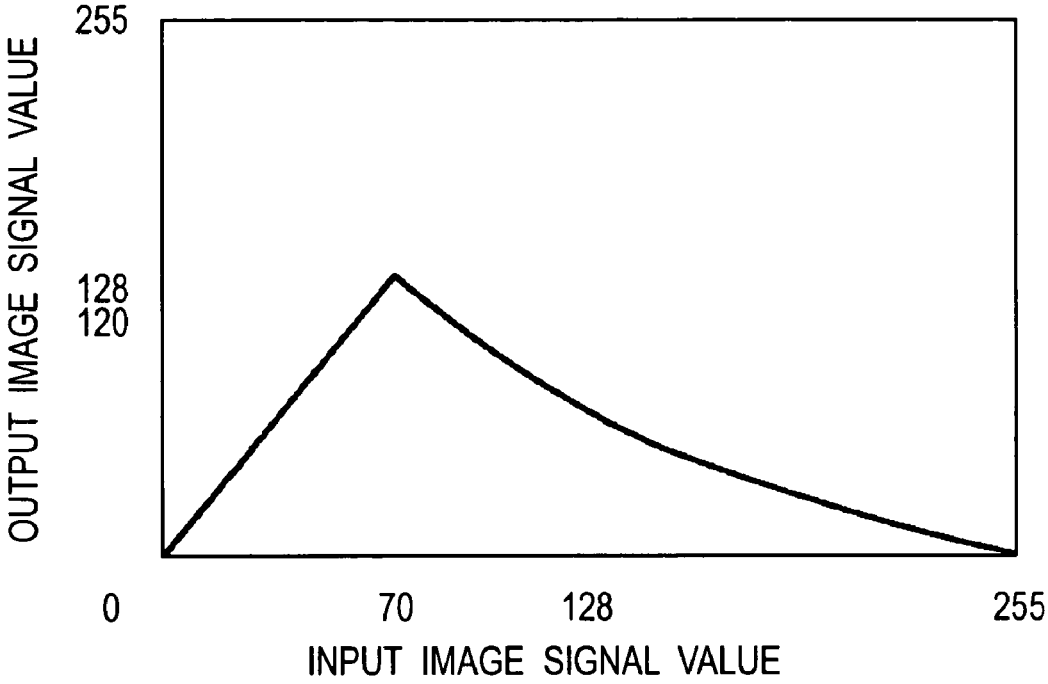
FIG. 5 is a graph schematically showing an LUT (look-up table) for pale color toner in an ordinary temperature and humidity environment in an embodiment of the present invention.

FIG. 5 shows an LUT for the pale color toner in the ordinary temperature and humidity environment.

In the image formation in the ordinary temperature and humidity environment, the LUT is set so that the pale color toner has a maximum output image signal value of about 120. This setting is effected so as to suppress the consumption of the pale color toner in order that the consumption of the pale color toner is equalized with that of the deep color toner described hereinafter. In this embodiment, as shown in FIG. 5, the LUT for the pale color toner is set so that the output image signal value is increased with the input image signal value up to an input image signal value (about 70) such that an output image signal of the deep color toner described later is started to be generated, and then is decreased therefrom.

Thereafter, binarization is performed (S18), and the binarized image data are stored in an image memory (S19), subjected to D/A conversion (S20), and transmitted to the laser driver (S21) to drive the laser, thus effecting image formation.

The electrostatic latent images formed on the photosensitive drums 1*a* to 4*a* by the laser light exposure are developed as toner images with the pale color toners by the first developing apparatuses 1*c*1 to 4*c*1, respectively. The thus formed toner images are primary-transferred onto the intermediary transfer belt 12 by the first transfer apparatuses 1*e* to 4*e*.

As described above, an LUT conversion for the pale color toner is performed, whereby the pale color toner is positively used at the low image density portion with respect to the reading image signal. As a result, at the low image density portion, the resultant image density per one dot is decreased, so that it becomes possible to reduce the granulation of one dot which has been a drawback of the binary (two-valued) image.

Next, second original scanning is performed (S22). In the image forming apparatus in this embodiment, it is necessary to effect reader scanning again in view of memory circumstances during second image formation. The image signal at the time of the second scanning is similarly processed as in the first scanning up to the gamma correction (S23 to S27). Thereafter, an LUT conversion for the deep color toner is peg formed (S28) and binarization is effected (S29). The binarized image data are stored in an image memory (S30), subjected to D/A conversion (S31), and transmitted to a laser driver (S32) to drive a laser, thus effecting image formation.

Next, second original scanning is performed (S22). In the image forming apparatus in this embodiment, it is necessary to effect reader scanning again in view of memory circumstances during second image formation. The image signal at the time of the second scanning is similarly processed as in the first scanning up to the gamma correction (S23 to S27). Thereafter, LUT conversion for deep color toner is performed (S28) and binarization is effected (S29). The binarized image data are stored in an image memory (S30), subjected to D/A conversion (S31), and transmitted to a laser driver (S32) to drive a laser, thus effecting image formation.

Figure 6:
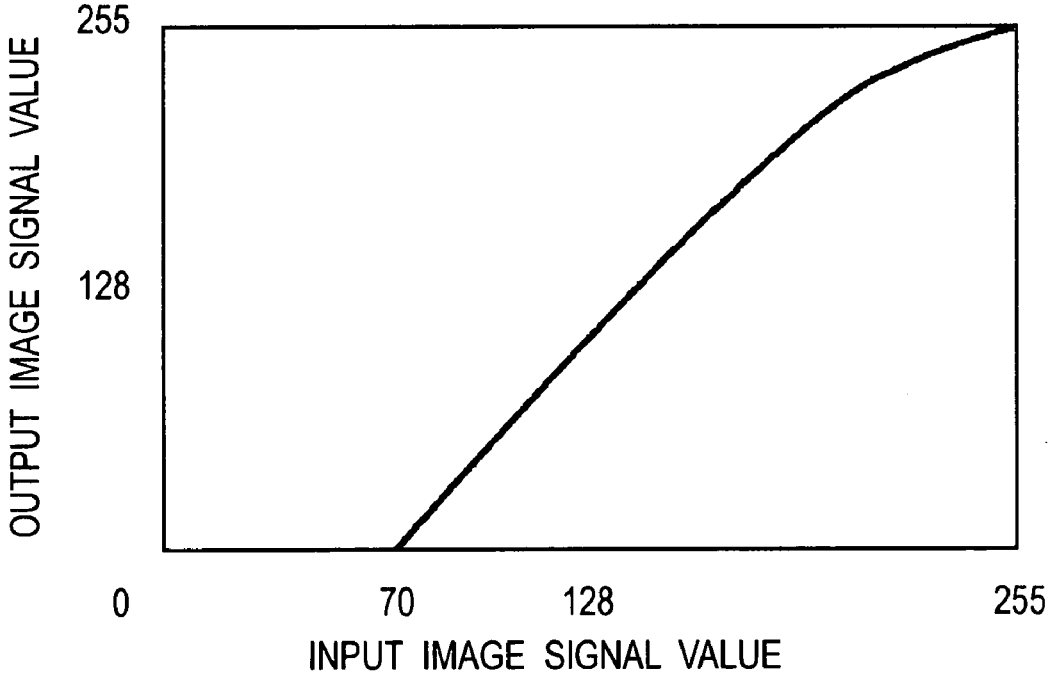
FIG. 6 is a graph schematically showing an LUT for deep color toner in an ordinary temperature and humidity environment in an embodiment of the present invention.

FIG. 6 shows an LUT for the deep color toner in the ordinary temperature and humidity environment. As described above, in the image formation in this temperature and humidity environment, the LUT is set so that the consumption of the pale color toner is suppressed. Accordingly, the LUT for the deep color toner is set so that the output image signal is started to be generated from the input image signal value of about 70 falling under a relatively low image density region.

The electrostatic latent images formed on the photosensitive drums 1*a* to 4*a* by the laser light exposure are developed as toner images with the deep color toners by the first developing apparatuses 1*c*2 to 4*c*2, respectively. The thus formed toner images-are primary-transferred again onto the intermediary transfer belt 12, on which the toner images of the pale color toners have already been formed, by the first transfer apparatuses 1*e* to 4*e*. After the toner images of the combination of the deep and pale color toners are formed, the toner images are secondary-transferred onto the transfer material P fed from the paper supply cassette 13 by the secondary transfer apparatus 11, followed by fixation on the transfer material P by the fixing apparatus 9 to be discharged out of the image forming apparatus.

Figure 7:
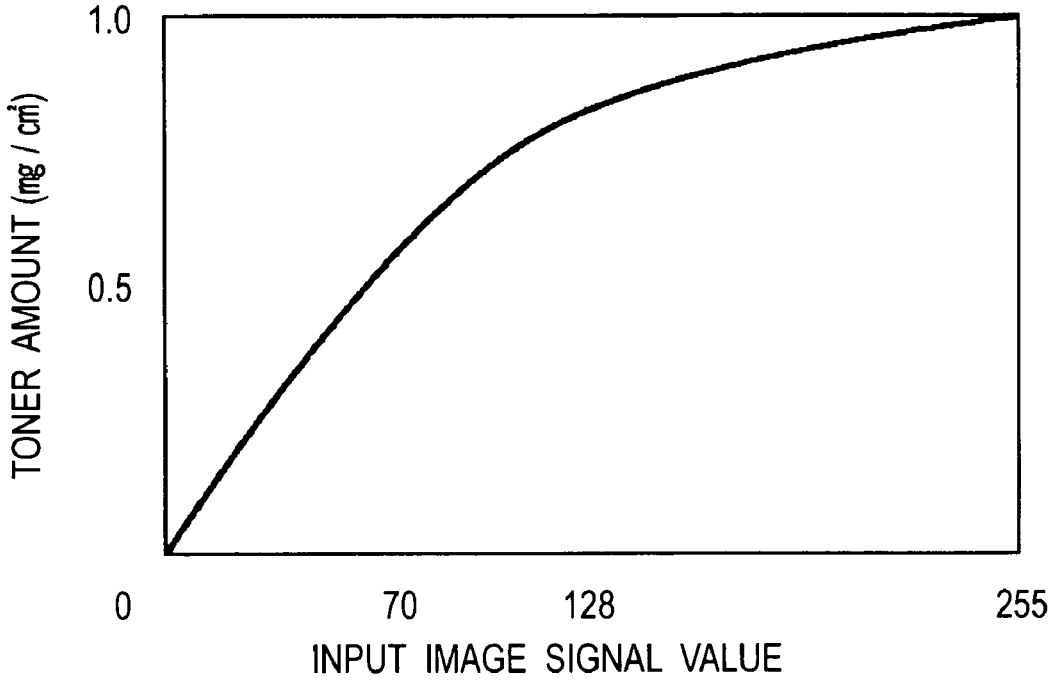
FIG. 7 is a graph schematically showing a relationship between an input image signal value and an amount of toner per unit area on a transfer material in an ordinary temperature and humidity environment in an embodiment of the present invention.

As described above, it becomes possible to effect image formation with the deep and pale color toners. By using the LUT for the pale color toner and the LUT for the deep color toner, gradation levels of magenta, cyan, yellow and black are reproduced by properly mixing two kinds of toners (the deep and pale color toners). In the ordinary temperature and humidity environment, an amount of toner per unit area during the image formation is shown in FIG. 7.

2-2) Low Humidity Environment Mode (Second Image Formation Mode)

Next, a flow of an image signal in the case where an image is formed in the low humidity environment will be described.

As described above, in the low humidity environment, the image forming apparatus is placed in such a state that image deterioration is liable to occur due to the discharge phenomenon in the vicinity of the transfer portion, i.e., the secondary transfer portion T' in this case.

More specifically, due to the discharge generated between the intermediary transfer belt 12 and the transfer material P at a portion upstream from the secondary transfer apparatus 11 in the conveyance direction of the transfer apparatus 11 in the conveyance direction of the transfer material P, such a phenomenon that transfer failure in a shape of a flower-like pattern having a length of about 2 mm and a width of about 2 mm is caused, occurs. Further, due to the discharge when the transfer material P is discharged from the secondary transfer apparatus 11, such a phenomenon that the resultant image is disordered in a maple-leaf pattern. Further, due to the discharge generated between a post-transfer guide 14 for conveying the transfer material P from the secondary transfer apparatus 11 to the fixing apparatus 9, and the transfer material P, such a phenomenon that the toner is disordered in a circular shape having a diameter of about 2–20 mm.

All these phenomena are a phenomenon that the toner image on the transfer material P is disordered by the discharge.

In this regard, it has been clarified that the toner image is less affected by the phenomenon with a larger toner coverage on the transfer material P. A mechanism of the occurrence of discharge may be attributable to the following cause. Generally, a transfer bias (voltage) is applied on the basis of a maximum amount of toner per unit area, so that an excessive transfer bias (voltage) is applied to a portion where there is no toner, i.e., an excessive electric charge is present on the surface of the transfer material, in the case where the amount of toner per unit area is smaller than the maximum amount of toner per unit area as in a halftone image. Such an excessive electric charge causes discharge when the transfer material passes through the transfer portion. Particularly, in the case where the image formation is performed in the low humidity environment or the transfer material has a low water (moisture) content, an electric resistance of the transfer material is increased to place the excessive electric charge on the surface of transfer material in such a state that it is more liable to be held on the transfer material surface, so that the excessive electric charge is not readily neutralized electrically through the photosensitive drum (image bearing member) or the transfer material as in the ordinary temperature and humidity environment. As a result, it is considered that discharge is liable to occur due to the presence of the excessive electric charge which has not been electrically neutralized and remains on the transfer material surface.

On the other hand, the above-described phenomena are such a phenomenon that the toner image has a white dropout portion in the halftone image, so that a contrast of optical density is small at a highlight portion having an optical density of less than about 0.3 and thus the phenomenon is less conspicuous. However, the phenomenon is liable to be conspicuous at an optical density of not less than about 0.3.

Accordingly, with respect to the image deterioration due to discharge in the low humidity environment, it is important to obviate the above-described various phenomena principally in the halftone optical (image) density area.

In the case of forming an image in the low humidity environment, it is possible to obviate the influence of image deterioration due to the above-described discharge phenomena by increasing the amount of toner per unit area on the transfer material P in the halftone area.

Hereinbelow, the basic flow of image signal will be described. The basic flow of image is the same as that during image formation in the ordinary temperature and humidity environment described above except that LUTs used in the steps S17 and S28 in FIG. 4 are different from those in the case of the ordinary temperature and humidity environment.

Figure 8:
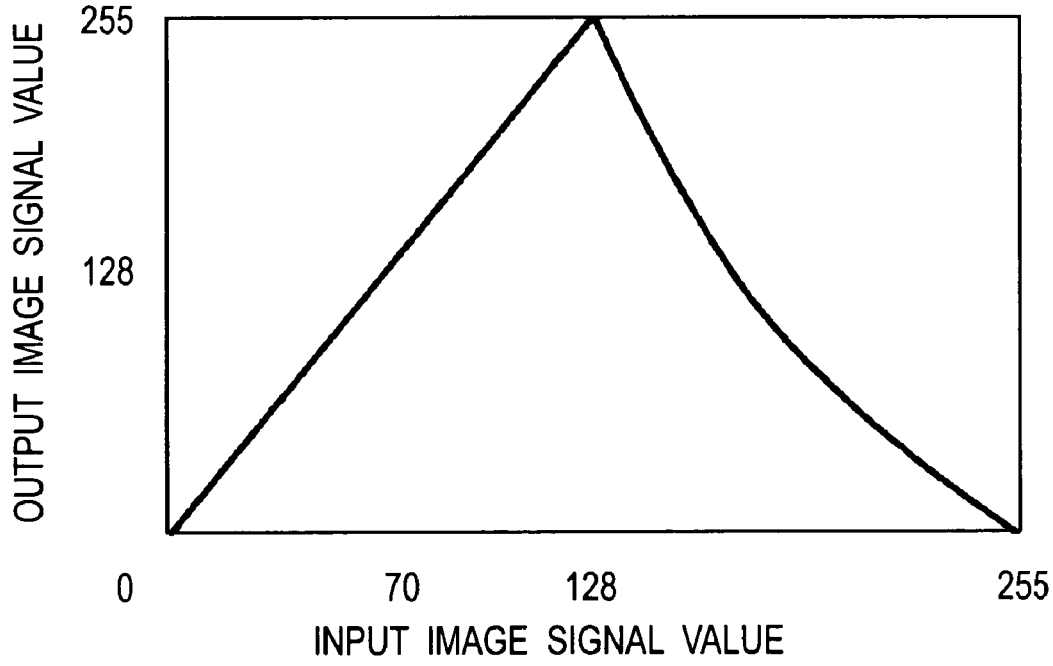
FIG. 8 is a graph schematically showing an LUT for pale color toner in a low humidity environment in an embodiment of the present invention.
Figure 9:
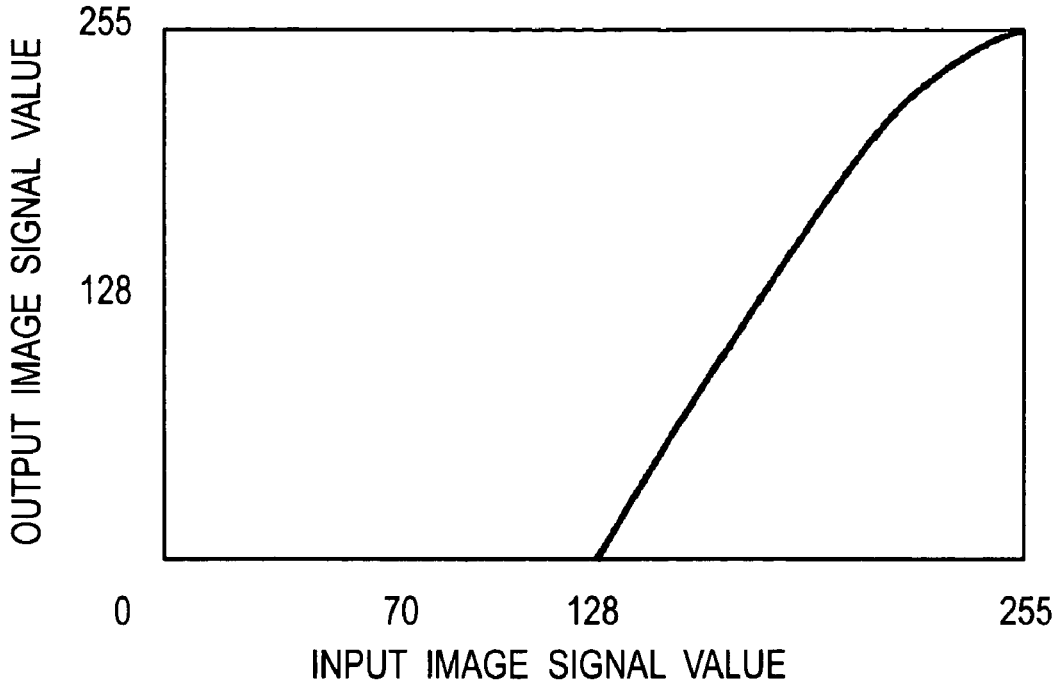
FIG. 9 is a graph schematically showing an LUT for deep color toner in a low humidity environment in an embodiment of the present invention.

The LUT for the pale color toner used in the step S17 in the low humidity environment is shown in FIG. 8 and the LUT for the deep color toner used in the step S28 in the low humidity environment is shown in FIG. 9.

As show in FIG. 8, in this embodiment, compared with the image formation in the ordinary temperature and humidity environment, an output image signal value for the pale color toner is increased during image formation in the low humidity environment. Further, as shown in FIG. 9, compared with the image formation in the ordinary temperature and humidity environment, the LUT for the deep color toner is set so that the output image signal is started to be generated from the input image signal value of about 128 by narrowing a range of the input image signal value generating the output image signal for the deep color toner.

More specifically, in this embodiment, the LUT for the pale color toner used in the low humidity environment is set so that the output image signal value is increased with the input image signal value up to the input image signal value (about 128) which is higher than that in the ordinary temperature and humidity environment and at which the output image signal for the deep color toner is started to be generated, and is then started to be decreased from a higher output image signal level.

Figure 10:
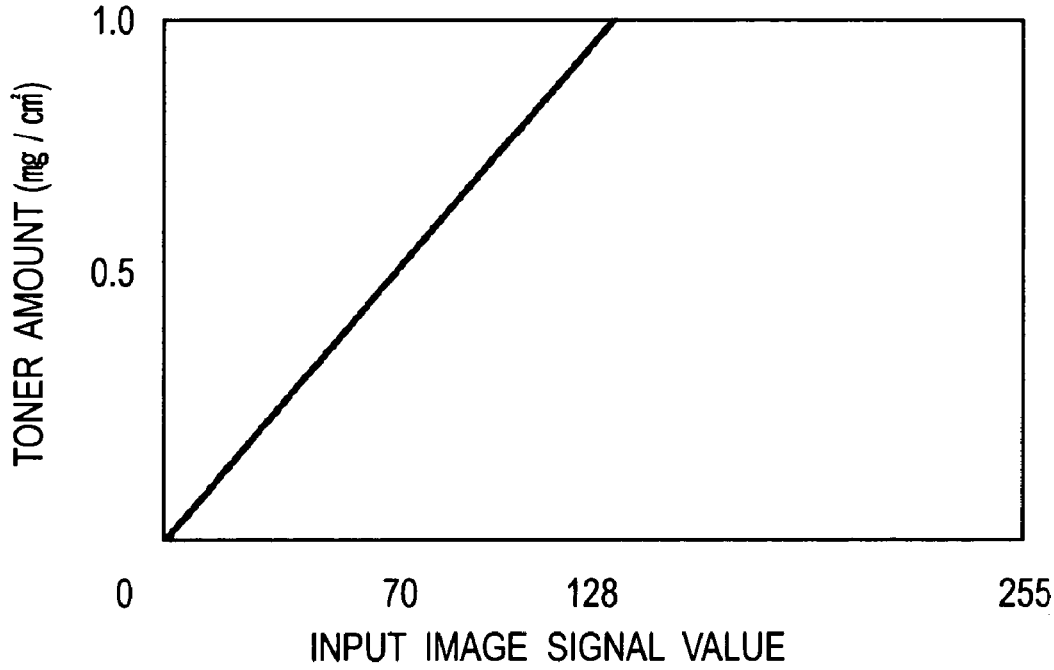
FIG. 10 is a graph schematically showing a relationship between an input image signal value and an amount of toner per unit area on a transfer material in a low humidity environment in an embodiment of the present invention.

By doing so, an amount of the pale color toner in the mixture thereof with the deep color toner is increased, whereby a larger amount of toner is placed on the transfer material P. More specifically, as shown in FIG. 10, the amount of toner per unit area during image formation in the low humidity environment is larger than that during image formation in the ordinary temperature and humidity environment shown in FIG. 7 in a range in which the input image signal value is not less than about 70. Accordingly, it is possible to obviate the occurrence of image deterioration due to the discharge in the vicinity of the transfer portion in the halftone image.

In this embodiment, the mixing ratio between the deep and pale color toners is changed by controlling an exposure amount (exposure time or exposure output) of the latent image forming means as a changing means for changing the toner mixing ratio depending on the output image signal of the LUT on the basis of detection results of the temperature and humidity of the ambient temperature. Further, the changing means usable in the present invention is not limited to that used in the above embodiment but may include any means so long as it can change the toner mixing ratio. For example, it is possible to change the mixing ratio between the deep and pale color toners to be used for development on the image bearing member by changing a voltage applied to the developing means or controlling an amount of electric charge of toner in the developer container.

As described above, in the image quality priority mode for forming an image by using both of the pale color toner and the deep color toner, different from the image formation using only the deep color toner (i.e., the speed priority mode in this embodiment or the image formation by the conventional image forming apparatus using only four toners of yellow, magenta, cyan and black), it is possible to control the amount of toner per unit area in the intermediary optical (image) density range without changing the resultant image density.

By increasing the amount of toner per unit area in the intermediary image density range, i.e., by increasing the amount (proportion) of pale color toner in the mixture of the deep and pale color toners, it becomes possible to obviate the image deterioration due to the discharge phenomenon, in the vicinity of the transfer portion in the low humidity environment, which is particularly problematic in the intermediary image density range. This is a particularly considerable advantage by the use of the combination of toners having the identical hue and different color densities. It is also possible to achieve the reduction of granulation at the low image density portion at the same time.

(Embodiment 2)

An image forming apparatus used in this embodiment is identical to the image forming apparatus 100, used in Embodiment 1, described with reference to FIGS. 1 to 4.

In this embodiment, a maximum amount of toner is increased compared with that under the ordinary image forming condition by increasing the amounts of pale and deep color toners per unit area under a specific image forming condition.

As described in Embodiment 1, in the low humidity environment, it is preferable that the amount of toner per unit area is increased in order to suppress the image deterioration in the vicinity of the transfer portion.

Further, generally, in order to prevent winding of the transfer material P due to adhesive force between the toner image and the fixing member in the fixing apparatus 9, an upper limit of the amount of toner per unit area is set to a certain value. However, in the low humidity environment, the winding of the transfer material P in the fixing apparatus 9 is not readily caused to occur when compared with the case of a high humidity environment, so that it is possible to increase the upper limit of the amount of toner per unit area of the image formed on the transfer material P.

Accordingly, in this embodiment, by increasing the amount of toner per unit area in such a range wherein the image density is not less than that of the halftone image, the image deterioration particularly in the high image density range in the vicinity of the transfer portion in the low humidity environment can be obviated.

Figure 11:
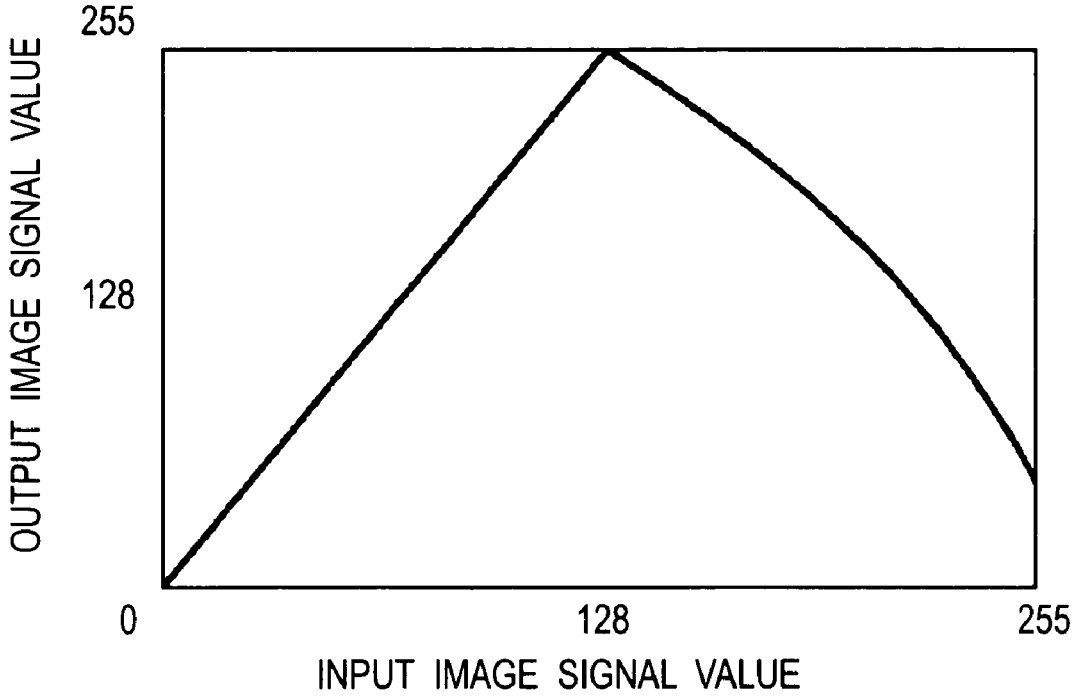
FIG. 11 is a graph schematically showing an LUT for pale color toner in a low humidity environment in another embodiment of the present invention.

Hereinbelow, an LUT used in the image quality priority mode and in the low humidity environment as a most characteristic feature in this embodiment will be described. FIG. 11 shows an LUT for pale color toner in the low humidity environment, and FIG. 12 shows an LUT for deep color toner in the low humidity environment.

Figure 12:
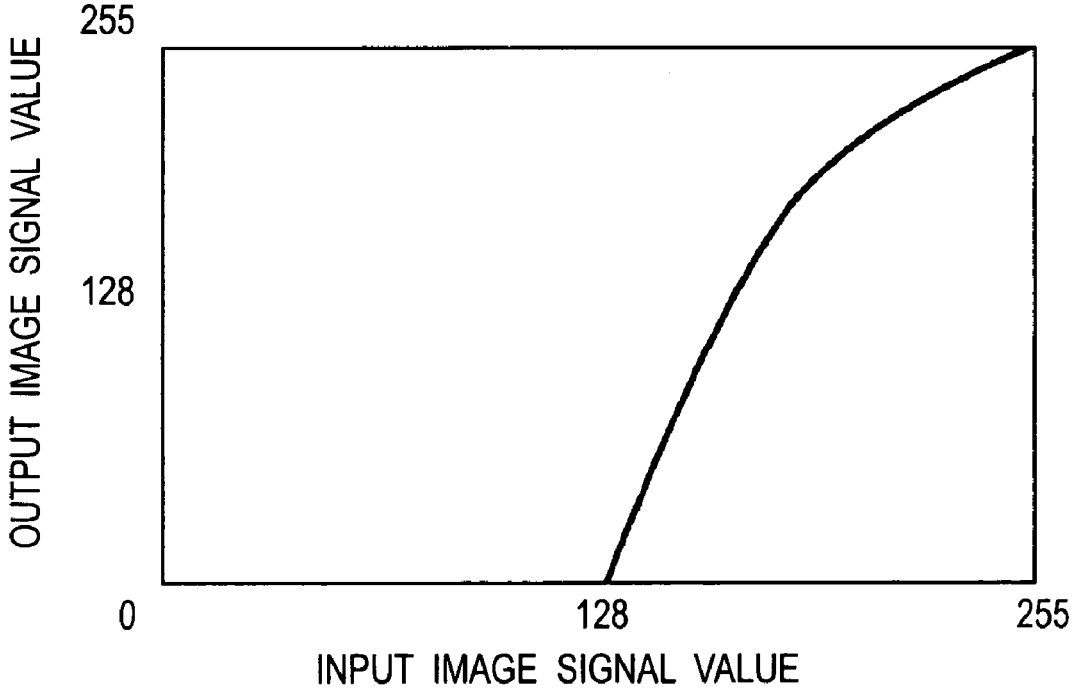
FIG. 12 is a graph schematically showing an LUT for deep color toner in a low humidity environment in another embodiment of the present invention.

As shown in FIGS. 11 and 12, similarly as in Embodiment 1, in the low humidity environment in this embodiment, the LUTs are set so that the output image signal is started to be generated from the input image signal value of about 128 by narrowing a range of the input image signal value generating the output image signal value for the deep color toner.

Figure 13:
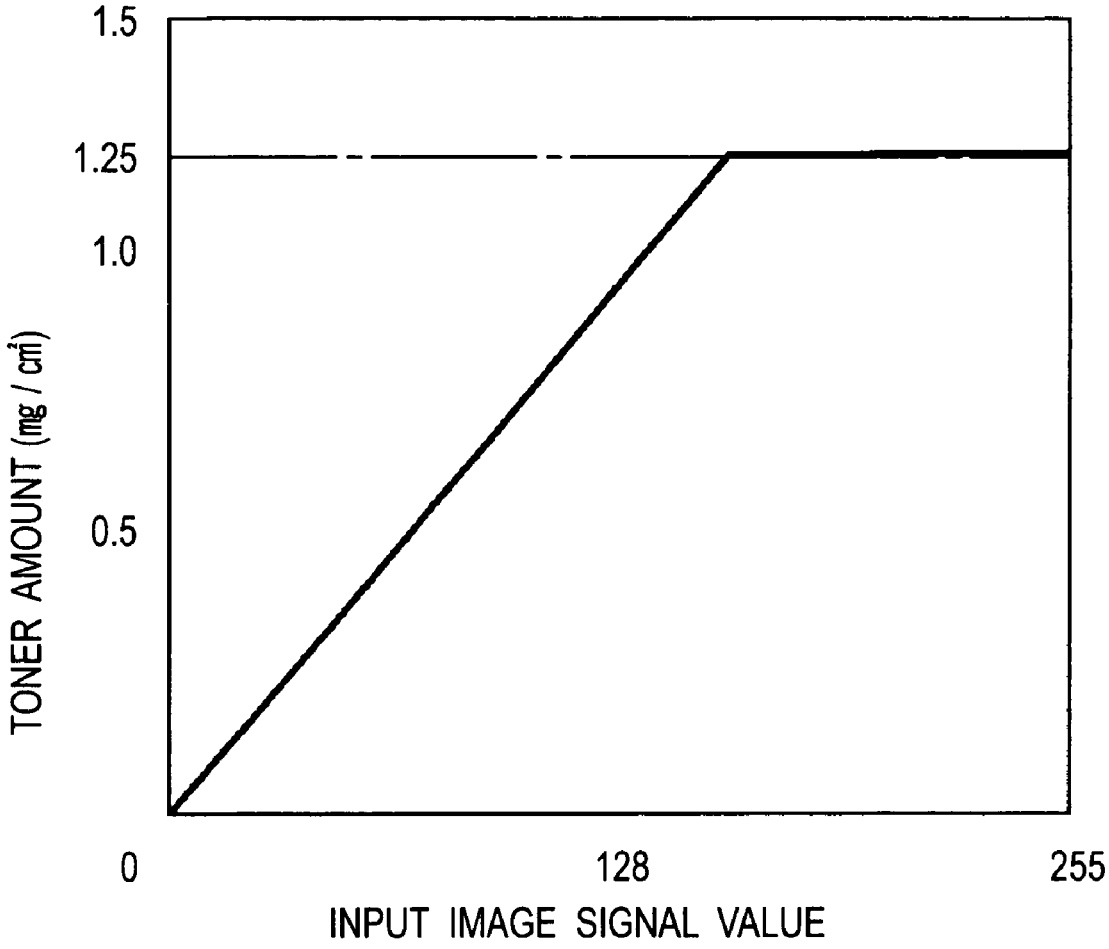
FIG. 13 is a graph schematically showing a relationship between an input image signal value and an amount of toner per unit area on a transfer material in a low humidity environment in another embodiment of the present invention.

Further, in this embodiment, both the LUT for the pale color toner and the LUT for the deep color toner are set so that the respective output image signal values in the range exceeding the input image signal value of 128 are higher than those in the LUT for the pale color toner (FIG. 8) and the LUT for the deep color toner (FIG. 9) in the low humidity environment, respectively. As a result, as shown in FIG. 13, the amount of toner per unit area in the low humidity environment is set to be larger than that in the ordinary temperature and humidity environment in the higher image density range. The maximum amount of toner per unit area is 1.25 mg/cm$^2$.

According to this embodiment, the maximum image density is increased but it is possible to minimize the image deterioration in the vicinity of the transfer portion in the higher image density range. This is a particularly considerable advantage by the use of the combination of toners having the identical hue and different color densities. It is also possible to achieve the reduction of granulation at the lower image density portion.

(Embodiment 3)

In the above-described Embodiments 1 and 2, as the specific image forming condition such that the image deterioration due to the discharge phenomenon in the vicinity of the transfer portion is liable to occur, the low humidity environment is employed but such a specific image forming condition is not limited thereto.

For example, the specific image forming condition may be a water (moisture) content of the transfer material. This is because, similarly as in the case of the temperature and humidity of ambient environment, the discharge phenomenon is liable to occur n the vicinity of the transfer portion when the water content is low. In this case, as a detection means of the image forming condition, for example, a means for detecting the water content of the transfer material by measuring an electric resistance of the transfer material or a means for detecting the water content of the transfer material on the basis of an infrared absorptance is provided so as to automatically determine the water content of the transfer material. In correspondence with its output, the controlling unit 101 can determine whether the image forming mode is the ordinary environment mode or a low water content mode similar to the above-described low humidity environment mode. Further, the image forming apparatus may have information, in advance, on the water content of transfer material which has been experimentally obtained from either one or both of temperature and humidity. As described above, humidity and/or temperature information of ambient environment is directly detected, whereby it is also possible to change the mixing ratio between the deep and pale color toners depending on the detection result. Further, the mixing ratio between the deep and pale color toners may also be changed depending on a value of humidity and/or temperature information inputted externally.

Further, the specific image forming condition may be second surface image formation in double-sided image formation of the transfer material P. As is well known in the art, there is an image forming apparatus equipped with a transfer material inversion mechanism to permit double-sided image forming mode for forming a recording image on both sides (surfaces) of the transfer material P, as shown in FIG. 1. Referring to FIG. 1, in the case where an image is formed on both of a first surface and a second surface of the transfer material P in this order, immediately after the transfer material P having the first surface on which the image is formed is passed through the fixing apparatus 9, a conveyance path guide 40 is driven to once guide the transfer material P to an inversion path 42 through a conveyance path 41. Thereafter, an inversion roller 43 is rotated reversely, whereby the transfer material P is fed to a double-sided image forming conveyance path 45 in a direction opposite from the conveyed (guided) direction with the previous trailing end at the top thereof. Thereafter, the transfer material P is conveyed to the transfer portion (secondary transfer portion T') at a predetermined timing through double-sided image formation conveyance roller 44, and an image is transferred onto the second surface of the transfer material P. During the image formation on the second surface of the transfer material P in the double-sided image formation mode of such an image forming apparatus, the transfer material P is once passed through the fixing apparatus 9, so that the water content is remarkably lowered. As a result, image deterioration is liable to occur due to the discharge in the vicinity of the transfer portion. In this case, when the image is formed on the second surface of the transfer material P in the image quality priority mode, the controlling unit 101 selects a second surface image formation mode similar to the low humidity environment mode described above.

Further, the specific image forming condition may be whether the transfer material P is thick paper or not. This is because an applied bias voltage in the transfer apparatus (the secondary transfer apparatus 11 of the image forming apparatus 100 in FIG. 1) is set to be a higher level. Herein, the thick paper ordinarily has a basis weight of 110–300 g/cm$^2$ but may include any transfer material so long as a transfer bias voltage therefor is set to be higher than that for the transfer material P, such as plain paper, which is ordinarily used. In this case, the kind of the transfer material P may be inputted from the operating unit 103 by the operator or may also be determined automatically by providing, e.g., a thickness sensor of the transfer material, e.g., a thickness sensor of the transfer material P as a means for detecting (determining) the kind of transfer material P to a containing portion of the transfer material P or a conveyance path. In correspondence with the input from the operating unit 103 or the output of the sensor for determining the kind of the transfer material P, the controlling unit 101 determines whether the image forming mode is the ordinary environment mode or a thick paper mode similar to the above-described low humidity environment.

In all the above-described image forming conditions, it is possible to prevent the image deterioration due to the discharge phenomenon in the vicinity of the transfer portion by increasing the amount of temperature per unit area. Incidentally, in the case where two or more image forming conditions described above, in which the image deterioration due to the discharge in the vicinity of the transfer portion is liable to occur, such as the water content of the transfer material, the second surface image formation and the image formation on the thick paper, coincide one another, image formation may be performed by using a combination of the LUTs for the deep and pale color toners similar to the above-described low humidity environment mode which is different from the ordinary environment mode.

Accordingly, the specific image forming condition embraces any cause (condition) of the image deterioration such that the image deterioration caused by the discharge in the vicinity of the transfer portion can be prevented by increasing the amount of toner per unit area.

Other embodiments of the present invention will be described hereinbelow.

In the above-described embodiments, the image forming apparatus 100 includes four photosensitive drums 1*a* to 4*a* each subjected to development with deep and pale color toners but may include photosensitive drums which comprise a photosensitive drum for forming an image by using only a deep color toner and a photosensitive drum for forming an image by using only a pale color toner.

In the above-described embodiments, the pale color toners of yellow, magenta, cyan and black and the deep color toners of yellow, magenta, cyan and black are used. However, it is possible to use pale color toners of magenta and cyan and deep color toners of magenta and cyan may be used. In this case, it has been generally known that reduction in granulation can be achieved.

The developer used in the present invention may be a two component type developer comprising a mixture of toner and a carrier and a monocomponent type developer substantially comprising only toner.

In the transfer step in the image forming apparatus, images on the photosensitive drums 1*a* to 4*a* are transferred onto the transfer material P through the intermediary transfer belt 12 but may also be directly transferred onto the transfer material P.

Some specific embodiments of the image forming apparatus according to the present invention will be described.

Figure 14:
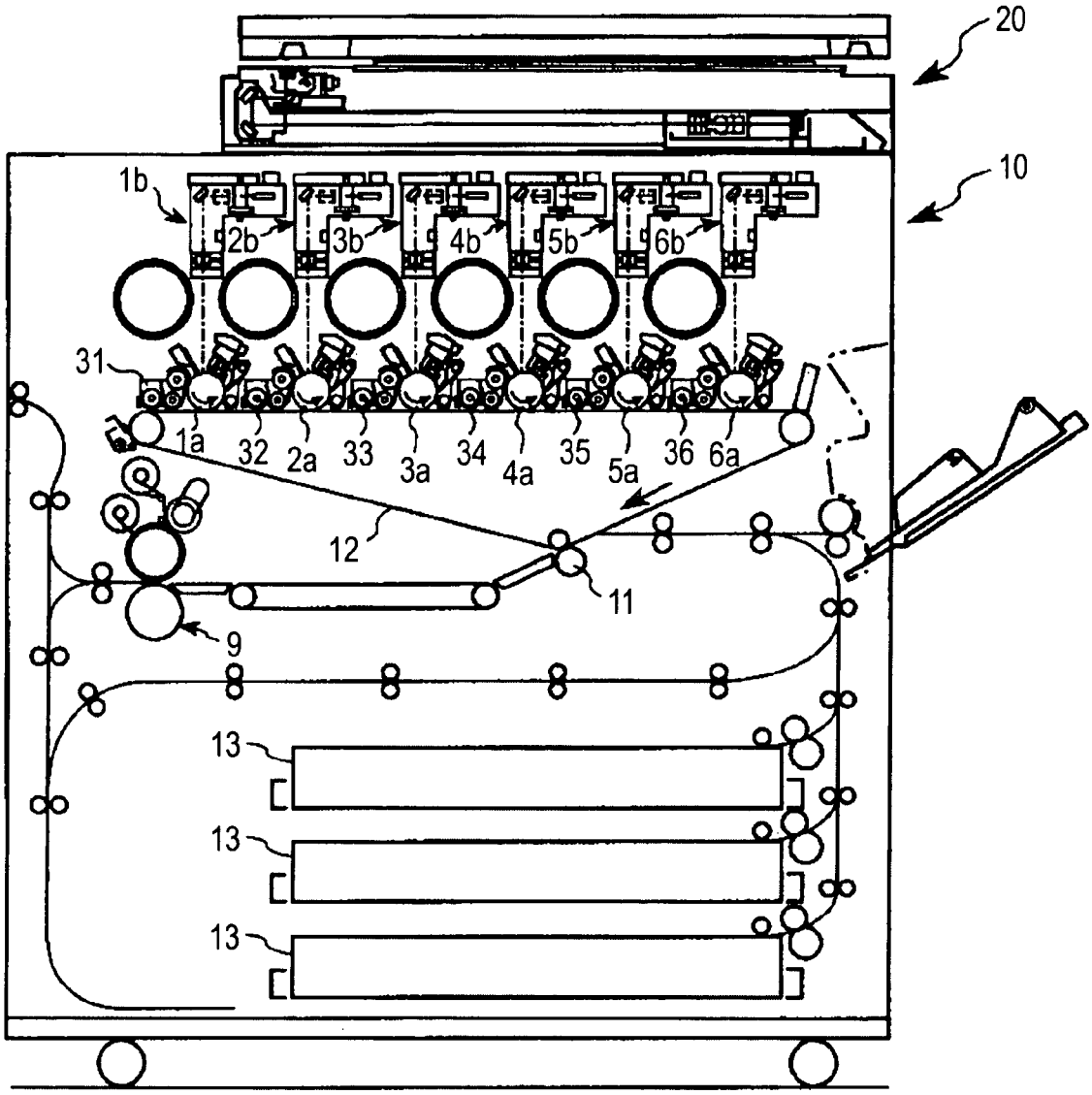
FIGS. 14, 15 and 16 are schematic sectional views showing another embodiment of the image forming apparatus according to the present invention.

A tandem type image forming apparatus shown in FIG. 14 includes six image bearing members 1*a*, 2*a*, 3*a*, 4*a*, 5*a* and 6*a* which are disposed in series, and their corresponding developing apparatuses 31, 32, 33, 34, 35 and 36 each containing a developer having a spectrum characteristic different from those of other developers. The image forming apparatus further includes exposure apparatuses 1*b*, 2*b*, 3*b*, 4*b*, 5*b* and 6*b* for performing image writing. The image forming apparatus of this type is capable of proving an identical output speed of image when compared with the four-color image forming apparatus, thus being a productivity-oriented type.

Figure 15:
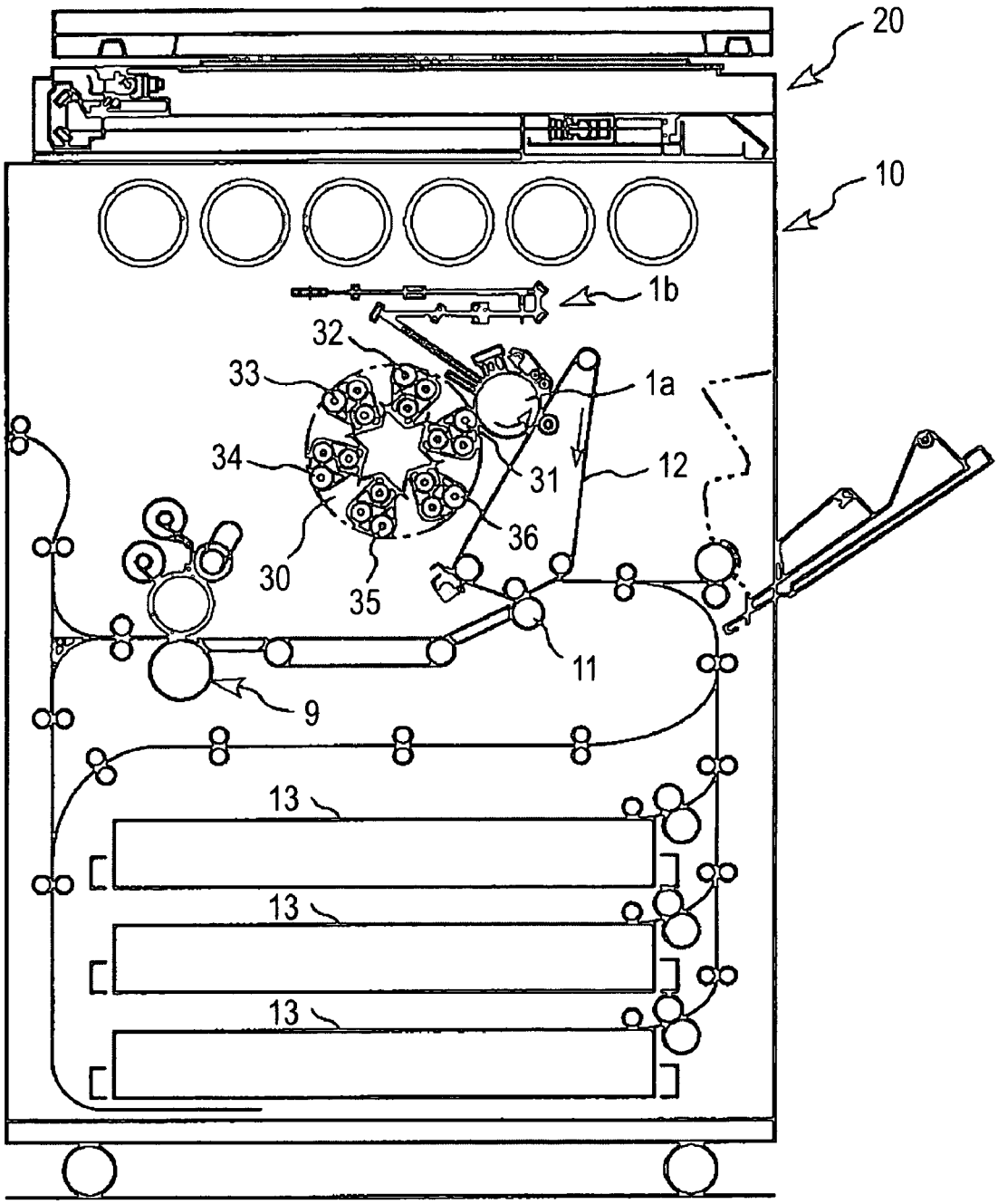

An image forming apparatus shown in FIG. 15 includes one image bearing member 1*a* and corresponding six developing apparatuses 31, 32, 33, 34, 35 and 36 (pale magenta, pale blue, yellow, magenta, cyan and black). These developing apparatuses 31 to 36 effect development while being switched by rotating a rotary unit (rotation body) 30 holding these developing apparatuses. An image for each color formed on the image bearing member 1*a* is successively primary-transferred onto the intermediary transfer member 12 to form a superposed image. After completion of the respective color toner images for six colors, the resultant color toner images for six colors, the resultant superposed image is secondary-transferred onto a transfer material fed from a paper supply apparatus 13 under the action of a secondary transfer apparatus 11. The image forming apparatus of this type is capable of outputting a six color-based toner image while minimizing space.

The image forming apparatus 100 shown in FIG. 1 is an electric mix of the image forming apparatuses shown in FIGS. 14 and 15. More specifically, the image forming apparatus of this type includes a plurality of image bearing members arranged in series and two developing apparatuses disposed in correspondence with each of the image bearing member. Accordingly, the image forming apparatus has a better balance between the characteristic features of both the image forming apparatuses shown in FIGS. 14 and 15, thus satisfying needs for small size, inexpensiveness and high speed.

Figure 16:
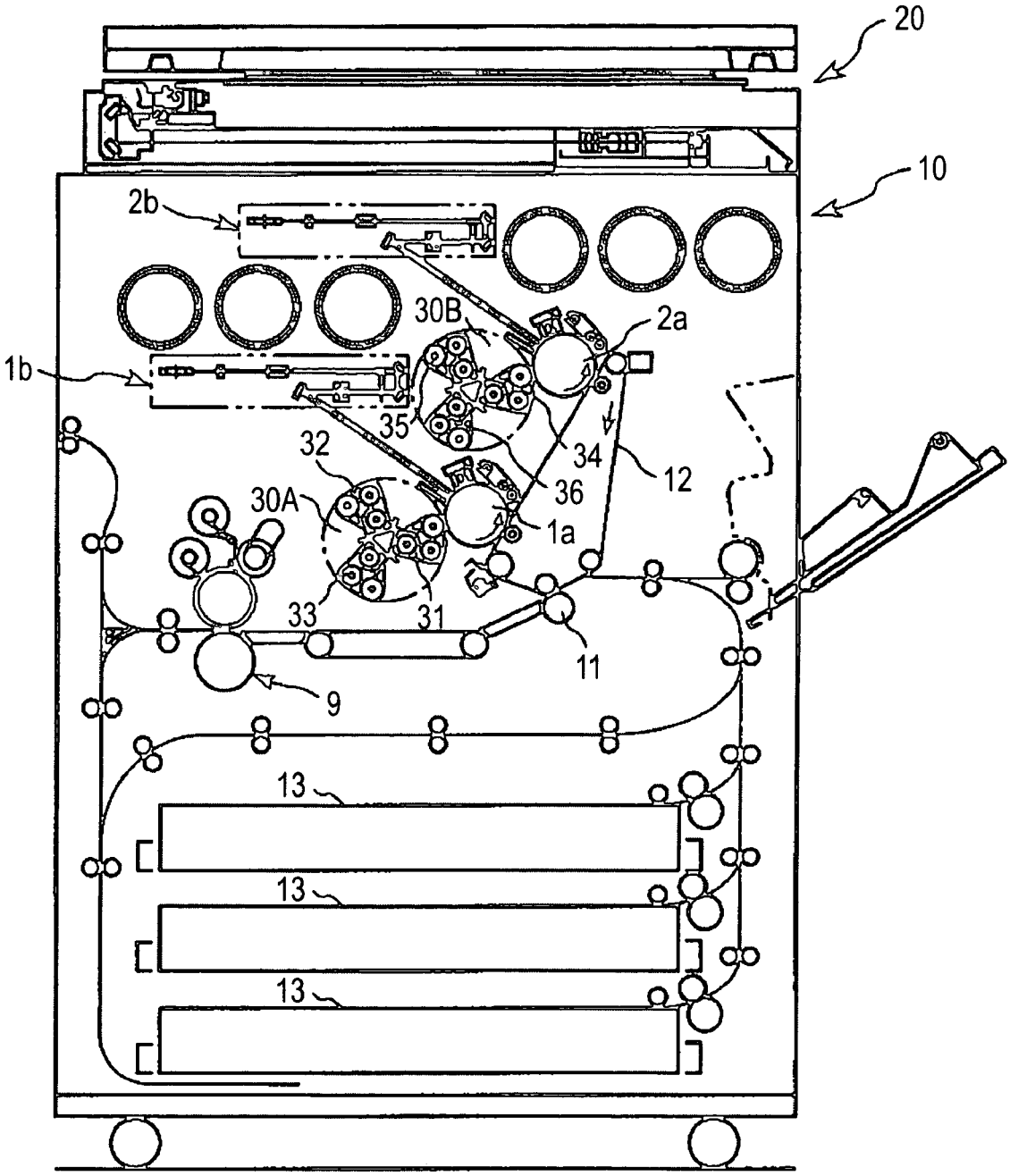

An image forming apparatus shown in FIG. 16 includes two image bearing members 1*a* and 2*a* and corresponding rotary units (rotation bodies) 30A and 30B each provided with three developing apparatuses (3) (magenta), 32 (pale magenta) and 33 (yellow) or 34 (cyan), 35 (pane cyan) and 36 (black)). Development is effected by rotating these rotary units 30A and 30B while switching the developing apparatuses. An image for each color formed on the image bearing members 1*a* and 2*a* is successively primary-transferred onto the intermediary transfer member 12 to form a superposed image. After completion of the respective color toner images for six colors, the resultant superposed image is secondary-transferred onto a transfer material fed from a paper supply apparatus 13 under the action of a secondary transfer apparatus 11. The image forming apparatus of this type, compared with the image forming apparatus shown in FIG. 1, has a constant gap between the exposure apparatus and the corresponding developing apparatus, thus further improving image quality.

As described hereinabove, according to the present invention, even when image formation is performed in the specific image forming condition, such as the low humidity environment, under which image deterioration due to the discharge phenomenon in the vicinity of the transfer portion is liable to occur, it is possible to prevent deterioration of an image, particularly a halftone image.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

image forming means for forming a superposed image on an image bearing member by using at least toners which have an identical hue and different color densities;

transfer means for electrostatically transferring the superposed image formed on the image bearing member onto a transfer material; and changing means for changing a mixing ratio between the toners which have an identical hue and different color densities depending on information relating to a water content of the transfer material.

2. An apparatus according to claim 1, wherein said changing means changes the mixing ratio so that an amount of a toner having a relatively low color density of the toners is increased when the transfer material has a water content which is lower than a predetermined value.

3. An apparatus according to claim 1, wherein the information on a water content of the transfer material comprises information relating to a temperature and a humidity in an ambient environment.

4. An apparatus according to claim 1, wherein the toners comprise a toner which has a relatively low color density and contains a pigment in an amount adjusted to provide the toner with an optical density of less than 1.0 per 0.5 mg/cm$^2$ of amount of the toner on the transfer material, and a toner which has a relatively high color density and contains a pigment in an amount adjusted to provide the toner with an optical density of not less than 1.0 per 0.5 mg/cm$^2$ of amount of the toner on the transfer material.

5. An apparatus according to claim 1, wherein said image forming means further comprises a latent image bearing member, latent image forming means for forming a latent image on the latent image bearing member, a plurality of developing means each for developing the latent image with toner, and transfer means for sequentially transferring developed toner images onto said image bearing member in a superposed manner, and wherein said plurality of developing means includes developing means in which a toner having an identical hue to and a different color density from toner contained in another developing means is contained.

6. An apparatus according to claim 5, wherein an amount of the toner having the identical hue and the different color density is changed by changing an amount of light exposure with respect to a latent image, formed by the latent image forming means, corresponding to an image of the toner.

7. An apparatus according to claim 5, wherein an amount of the toner having the identical hue and the different color density is changed by changing a developing bias voltage when a latent image is developed with the toner on the latent image bearing member by developing means.

* * * * *

UNITED STATES PATENT AND TRADEMARK OFFICE

CERTIFICATE OF CORRECTION

PATENT NO. : 7,130,550 B2
APPLICATION NO. : 10/900284
DATED : October 31, 2006
INVENTOR(S) : Jun Mochizuki It is certified that error appears in the above-identified patent and that said Letters Patent is hereby corrected as shown below:

COLUMN 1:
Line 32, “include” should read --includes--.

COLUMN 4:
Line 56, “formation” should read --formation stations--.

COLUMN 6:
Line 36, “limited” should read --limited to--.

COLUMN 7:
Line 13, “in th” should read --in the--.

COLUMN 9:
Line 26, “peg formed” should read --performed--.
Lines 30-40, should be deleted.
Line 54, “images-are” should read --images are--.

COLUMN 11:
Line 22, “show” should read --shown--.

COLUMN 14:
Line 56, “coincide” should read --coincide with--.

COLUMN 16:
Line 5, “(pane” should read --(pale--.

Signed and Sealed this

Thirty-first Day of July, 2007

JON W. DUDAS
*Director of the United States Patent and Trademark Office*